United States Patent [19]

Abe et al.

[11] Patent Number: 4,512,320

[45] Date of Patent: Apr. 23, 1985

[54] METHOD OF AND DEVICE FOR CONTROLLING FUEL INJECTION IN INTERNAL COMBUSTION ENGINE

[75] Inventors: Shinichi Abe; Mitsuharu Taura, both of Toyota; Hidetoshi Amano, Okazaki; Toshiaki Mizuno, Nagoya, all of Japan

[73] Assignees: Toyota Jidosha Kabushiki Kaisha, Toyota; Nippondenso Co., Ltd., Kariya, both of Japan

[21] Appl. No.: 590,051

[22] Filed: Mar. 15, 1984

[30] Foreign Application Priority Data

Mar. 28, 1983 [JP] Japan ..... 58-52187
Mar. 28, 1983 [JP] Japan ..... 58-52188

[51] Int. Cl.[3] ..... F02M 51/00

[52] U.S. Cl. ..... 123/492; 123/489; 123/491

[58] Field of Search ..... 123/492, 491, 489, 480, 123/493

[56] References Cited

U.S. PATENT DOCUMENTS 4,075,982 2/1978 Asano et al. ..... 123/492
4,144,847 3/1979 Hosaka ..... 123/492
4,227,507 10/1980 Takase et al. ..... 123/492
4,240,389 12/1980 Shimazaki ..... 123/492
4,399,790 8/1983 Kataoka ..... 123/492
4,463,732 8/1984 Isobe et al. ..... 123/491

*Primary Examiner*—Parshotam S. Lall
*Attorney, Agent, or Firm*—Cushman, Darby & Cushman

[57] ABSTRACT

The amount of engine acceleration is detected as the amount of change in the absolute pressure in the intake passage, and an asynchronous fuel injection is conducted regardless of the crank position as the amount of acceleration exceeds a predetermined reference value. In ordinary state of engine operation, the synchronous fuel injection is conducted in synchronism with the crank rotation such that the air-fuel ratio of the mixture coincides with the stoichiometric one, upon sensing the air-fuel ratio from the content of oxygen remaining in the exhaust gas. The mixture is made richer or leaner than the stoichiometric one in accordance with the state of operation of the engine. The judging level for the judgement as to whether the asynchronous fuel injection is necessary or not is increased or decreased in accordance with the air-fuel ratio so that the asynchronous fuel injection is conducted taking into account also the air-fuel ratio.

23 Claims, 31 Drawing Figures

METHOD OF AND DEVICE FOR CONTROLLING FUEL INJECTION IN INTERNAL COMBUSTION ENGINE

BACKGROUND OF THE INVENTION

The present invention relates to a method of and a device for controlling the fuel injection in an internal combustion engine. More particularly, the invention is concerned with a method of and a device for controlling the fuel injection in an internal combustion engine of the type in which an asynchronous fuel injection is conducted in response to the required degree of acceleration.

In a typical known electronic fuel injection controller, the basic fuel injection time duration, i.e. the basic time length of opening of the injector, is computed in accordance with the absolute pressure in the intake pipe and the engine speed. Then, various correcting computations are conducted on this basic fuel injection time duration in accordance with the states of operation of the engine including warming up of the engine, transient state of engine operation and so forth, thereby to determine the final fuel injection time duration. The fuel injection valve is opened for the thus determined final fuel injection time duration at predetermined crank angles or positions. This fuel injecting operation is referred to as "synchronous fuel injection".

On the other hand, when a quick acceleration of the engine is required, the fuel is injected regardless of the crank angle upon detect of the quick acceleration of the engine because, for otherwise, the driveability of the engine will be impaired if the fuel injection is not made till the predetermined crank angle is reached. This injecting operation conducted regardless of the crank angle is referred to as "asynchronous fuel injection".

Usually, the asynchronous fuel injection is conducted when the degree of acceleration has exceeded a predetermined judging or reference value. The asynchronous fuel injection in response to an asynchronous fuel injection demand is made in various forms or patterns. For instance, in one form of the asynchronous fuel injection, the fuel injection rate is maintained constant regardless of the state of engine operation. In another form, the fuel injection rate is varied in accordance with the degree of acceleration, such that the fuel is injected at a greater rate as the degree of acceleration is increased. In still another form, the fuel injection rate is varied in accordance with both of the degree of acceleration and the engine temperature, such that the fuel injection rate is increased when the degree of the engine acceleration is great and when the engine temperature is low.

In the engine operation under the asynchronous fuel injection, it is often experienced that the state of combustion is impaired by an improper air-fuel ratio of the mixture because the asynchronous injection is made, in some cases, without taking the air-fuel ratio into account. This unfavourably causes various problems such as deterioration of the engine performance, increase in the fuel consumption and worsening of the condition of the exhaust gas.

These problems are serious particularly in the lean control (feed-forward control) in which the air-fuel ratio is controlled for the leaner side under a specific condition of engine operation in order to improve the fuel consumption or in the rich control in which air-fuel ratio is controlled for richer side to obtain greater power under specific condition of engine operation, rather than in the feedback fuel injection control for maintaining the air-fuel ratio at the stoichiometric level in accordance with a signal from an $O_2$ sensor. Namely, when the asynchronous fuel injection is conducted in the lean control or the rich control mentioned above, it is necessary to control the injection rate in accordance with the air-fuel ratio because, in such engine operation modes, the fuel is burnt under a wide variety of air-fuel ratio.

SUMMARY OF THE INVENTION

Accordingly, it is an object of the invention to provide a method of controlling the fuel injection in an internal combustion engine, in which the asynchronous fuel injection is conducted under the condition which is determined in consideration of not only the degree of the engine acceleration but also the actual air-fuel ratio of the mixture which is being fed to the engine.

It is another object of the invention to provide a device for controlling the fuel injection in an internal combustion engine such that the asynchronous fuel injection rate is determined in view of not only the degree of the engine acceleration but also the air-fuel ratio of the mixture which is being fed to the engine.

To these ends, according to a first aspect of the invention, there is provided a method of controlling fuel injection in an internal combustion engine for effecting an asynchronous fuel injection from a fuel injector when the amount of the engine acceleration exceeds a predetermined judging level, comprising the steps of: detecting the air-fuel ratio of the mixture as an index of the state of combustion in the engine; and controlling the judging level in accordance with the air-fuel ratio such that the judging level is raised as the air-fuel ratio gets smaller.

In another form of the first aspect, the invention provides a method of controlling fuel injection in an internal combustion engine for effecting an asynchronous fuel injection from a fuel injector when the amount of the engine acceleration exceeds a predetermined judging level, comprising the steps of: detecting the air-fuel ratio of the mixture as an index of the state of combustion in the engine; and controlling the amount of fuel injected by the asynchronous injection in accordance with the air-fuel ratio such that the the amount of fuel injected is decreased as the air-fuel ratio gets smaller.

According to a second aspect of the invention, there is provided a device for controlling the fuel injection in an internal combustion engine comprising: an acceleration detecting means for detecting the amount of acceleration of the engine; an air-fuel ratio detecting means for detecting the air-fuel ratio as an index representing the state of combustion in the engine; a judging means adapted to make a judgement as to whether the asynchronous injection by an injector is necessary in accordance with a judging level and to allow the asynchronous fuel injection when the amount of engine acceleration exceeds the judging level; a judging level changing means adapted to control the judging level in accordance with air-fuel ratio detected by the air-fuel ratio detecting means such that the level is raised as the air-fuel ratio becomes smaller; and a signal generating means adapted to generating an injection signal for driving the injector for a predetermined time length when the asynchronous fuel injection is allowed by the judging means.

In another form of the second aspect, the invention provides a device for controlling the fuel injection in an internal combustion engine comprising: an acceleration detecting means for detecting the amount of acceleration of the engine; an air-fuel ratio detecting means for detecting the air-fuel ratio as an index representing the state of combustion in the engine; a judging means adapted to make a judgement as to whether the asynchronous injection by an injector is necessary in accordance with a judging level and to allow the asynchronous fuel injection when the amount of engine acceleration exceeds the judging level; a correcting means adapted to correct the amount of the fuel injected by the asyncronous injection such that the amount of fuel injected is decreased as the air-fuel ratio detected by the air-fuel ratio detecting means gets smaller; and a signal generating means adapted to generating an injection signal for driving the injector for the asynchronous fuel injection time duration corresponding to the corrected amount of fuel injected when the asynchronous fuel injection is allowed by the judging means.

Thus, in the first form of the invention, the judging level of amount of the engine acceleration for judgement as to whether the asynchronous fuel injection should be made or not is varied in accordance with the air-fuel ratio of the mixture which is being fed to the engine. Consequently, the asynchronous fuel injection, which is inherently conducted in accordance with the degree of the engine acceleration, is effected taking into account also the air-fuel ratio, thereby to ensure a good state of combustion in the internal combustion engine.

In the second form of the invention, the rate of asynchronous fuel injection is controlled in accordance with the air-fuel ratio of the mixture which is being fed to the engine. Consequently, the asynchronous fuel injection, which is inherently conducted in accordance with the amount of engine acceleration, is effected taking into account also the air-fuel ratio, thereby to ensure a good condition for the combustion in the engine.

DESCRIPTION OF THE PREFERRED EMBODIMENTS

Figure 1:
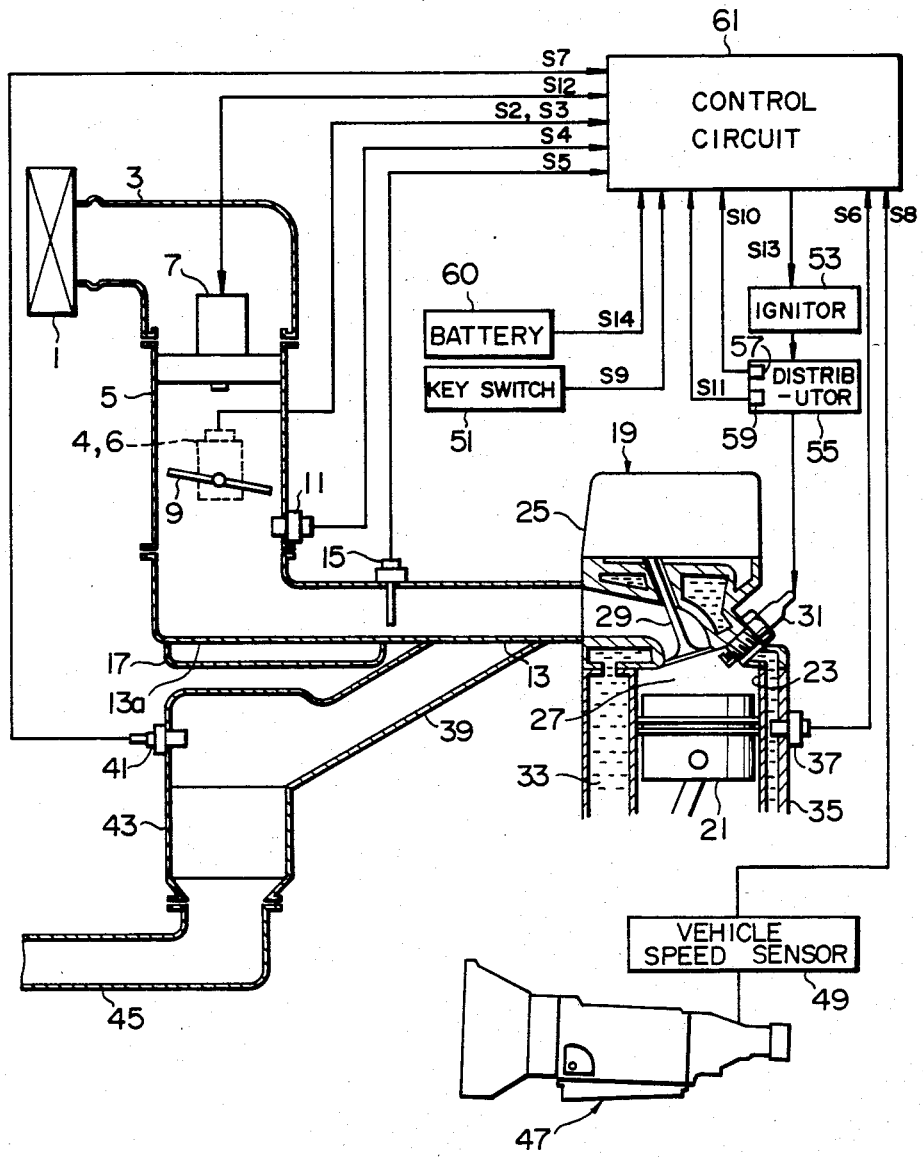
FIG. 1 is a schematic illustration of an example of an automotive internal combustion engine to which the present invention is applied.

FIG. 1 shows an example of automobile engine incorporating an electronic fuel injection controller in accordance with the invention. An air filter 1 is connected through an inlet pie 3 to a throttle body 5. The throttle body 5 is provided at the upstream side portion thereof with a fuel injector 7. A throttle valve 9 disposed at the downstream side of the fuel injector 7 is adapted to be operated by an accelerator pedal (not shown) so as to control the intake air flow rate. An absolute intake pressure sensor 11 is disposed at the downstream side of the intake throttle valve 9 to sense the absolute intake pressure at that portion of the intake passage.

The throttle valve 9 is associated with an idle switch 4 which is adapted to be held in "on" state only when the throttle valve 9 is in the substantially full closing position, and a power switch 6 which is adapted to take "on" state only when the opening degree of the throttle valve 9 is 50° or more.

The throttle body 5 is connected to an intake manifold 13 having branch pipes connected to respective cylinders of the engine. An intake air temperature sensor 15 is disposed in the intake manifold to sense the temperature of the intake air flowing in the intake manifold 13. An engine cooling water heated by the engine is circulated through a riser 17 provided on the botom wall 13*a* of the intake manifold upstream from the junction, thereby to heat the mixture flowing in the intake manifold 13.

An engine is generally designated at a reference numeral 19. As is well known, the engine 19 has combustion chambers 27 (only one of them is shown) defined by pistons 21, cylinders 23 and the cylinder head 25. The mixture induced into the combustion chamber 27 through the intake valve 29 is ignited by a spark plug 31. The cooling water is circulated through a water jacket 33 formed around the cylinder 23 thereby to cool the parts including the cylinder 23. A cooling water temperature sensor 37 attached to the outer wall of the cylinder block 35 is adapted to detect the temperature of the cooling water in the water jacket 33 as the representative or index of the engine temperature.

Branch pipes of an exhaust manifold 39 are connected to the exhaust ports (not shown) of the cylinder heads 25. An $O_2$ sensor for sensing the oxygen content in the exhaust gas is disposed at the downstream side portion of the exhaust manifold 39. The exhaust manifold 39 is connected through a ternary catalyst 43 to an exhaust pipe 45.

A reference numeral 47 designates a transmission conected to the engine 19. A vehicle speed sensor 49 is attached to the final output shaft of the transmission 47 to detect the speed of rotation of the final output shaft as the speed of the automobile. Reference numerals 51, 52 and 53 designate, respectively, a key switch, an igniter and a distributor. The distributor 55 is provided with an Ne sensor 57 which is adapted to produce an on-off signal for each of a predetermined crank angle $\theta_1$. It is possible to know an angular position of a crank shaft, as well as the engine speed, from the output of the Ne sensor 57. The distributor 55 is equiped also with a G sensor 59 which is adapted to produce an on-off signal at each of a predetermined crank angle $\theta_2$ which is greater than the above-mentioned crank angle $\theta_1$. It is possible to identify the cylinder and to detect the top dead center from the output of the G sensor 59.

A reference numeral 60 designates a series of battery.

A control circuit 61 is connected to various parts such as the idle switch 4, power switch 6, intake pressure sensor 11, intake air temperature 15, cooling water temperature sensor 37, $O_2$ sensor 41, vehicle speed sensor 49, key switch 51, Ne sensor 57, G sensor 59 and the battery 60. Thus, the control circuit 61 receives various signals such as an idle signal S2, power signal S3, intake pressure signal S4, intake air temperature signal S5, water temperature signal S6, air-fuel ratio signal S7, vehicle speed signal S8, start signal S9, engine speed signal S10, cylinder identification signal S11 and the battery voltage signal S14. The control circuit 61 is connected also to the injector 7 and the igniter 53 so as to conduct predetermined computations to deliver them a fuel injection signal S12 and a sparking signal S13.

Figure 2:
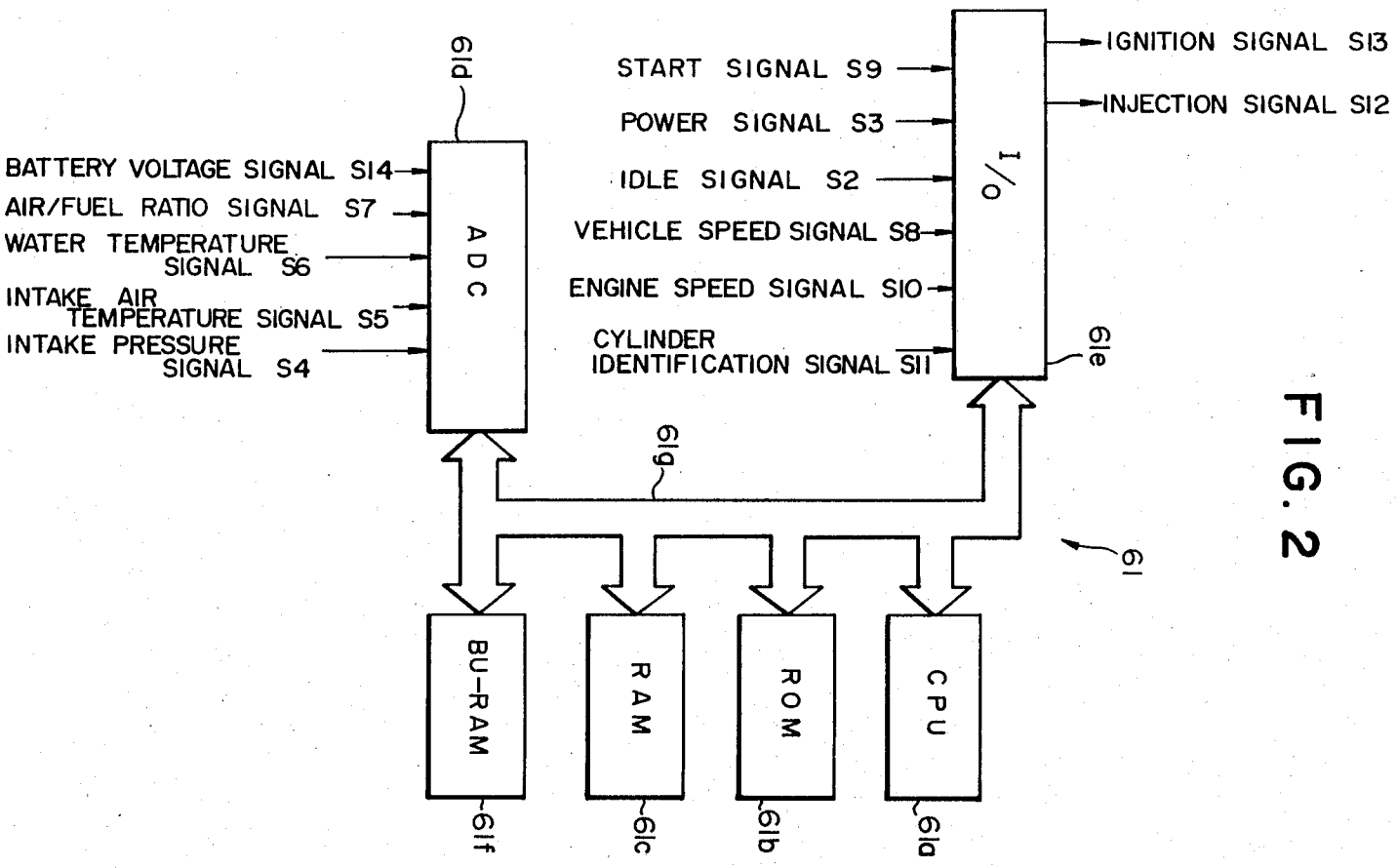
FIG. 2 is a block diagram of an example of the control circuit shown in FIG. 1.

As will be seen from FIG. 2, the control circuit 61 is composed of various parts such as a central processing unit (CPU) 61*a* for controlling various devices, read only memory (ROM) 61*b* in which various values and programs are pre-stored, random access memory (RAM) 61*c* having areas in which numerical values and flags under processing are written, an A/D converter (ADC) 61*d* which converts an analog input signal into a digital signal through a time division, an input/output interface (I/O) 61*e* through which various signals are delivered to and from the control circuit 61, a back-up memory (BU-RAM) 61*f* adapted to supply an electric power from an auxiliary power supply when the engine is stopped, and a BUS line 61*g* through which these parts are connected. A program which will be explained later is written beforehand in the ROM 61*b*.

Figure 3:
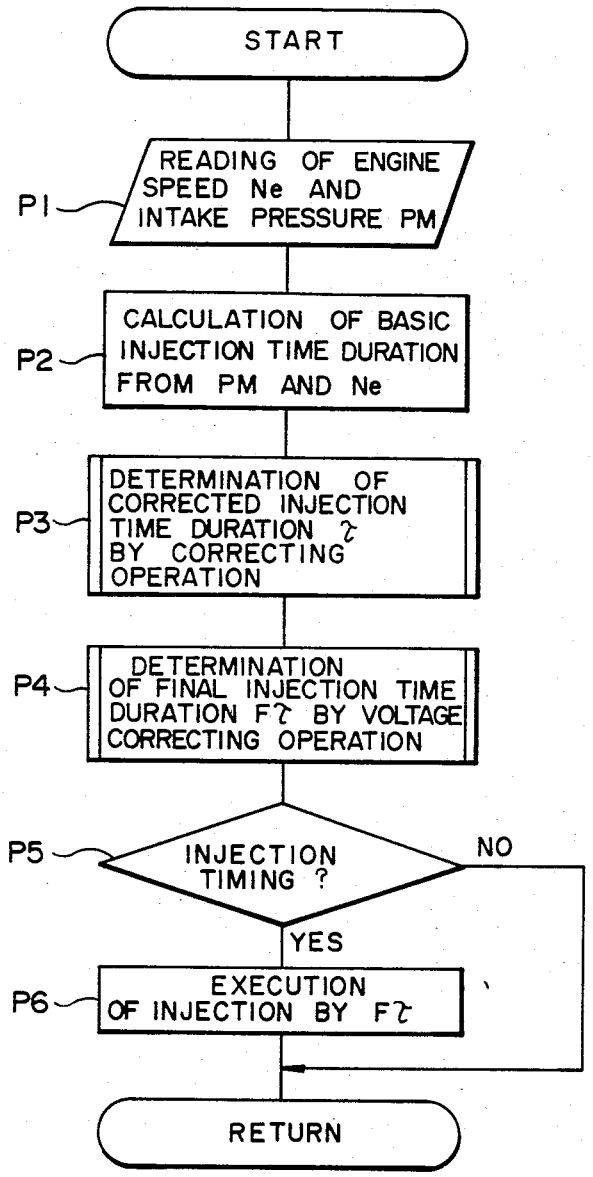
FIG. 3 is a flow chart of an example of a process for synchronous fuel injection.

In the engine described above, the fuel is injected at every predetermined crank angles in accordance with a flow chart shown in FIG. 3. Namely, the synchronous injection is executed.

Figure 4:
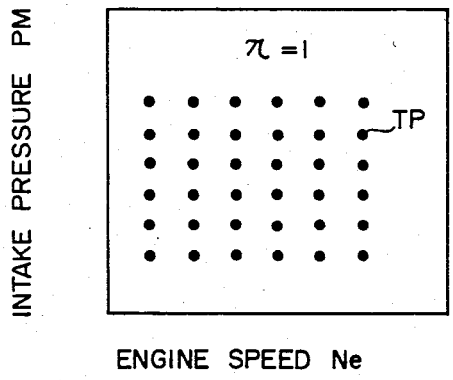
FIG. 4 is a diagram of an example of a map showing the basic fuel injection time TP with parameters of the engine speed Ne and the intake pressure PM.

Referring to FIG. 3, a step P1 is the step in which the engine speed Ne is read on the basis of the engine speed signal S1 which is the reference position signal, as well as the intake pressure PM on the basis of the intake pressure signal S4. In a step P2, the basic injection time TP is determined using a map as shown in FIG. 4 in accordance with the engine speed Ne and the intake pressure PM. In the next step P3, a correcting computation is conducted to compute the corrected synchronous injection time duration $\tau$. In a step P4, a further correction is made in accordance with the battery voltage thereby to determine the final injection time duration $F\tau$. Then, in a step P5, a judgement is made as to whether the present instant coincides with the injection timing. If the answer is affirmative, the injection signal S12 is delivered to the injector 7 in a step P6 thereby to drive the injector 7 for a predetermined time length.

A description will be made hereinunder as to the asynchronous fuel injection. In the described embodiment, the asynchronous fuel injection is conducted when the amount of change $d^2PM/dt^2$ in the intake pressure PM exceeds a predetermined value. Namely, whether the asynchronous fuel injection is necessary or not is judged by calculating the amount of change $d^2PM/dt^2$ in the intake pressure PM in accordance with the following procedure.

(Computation Processing of Intake Pressure PM)

Figure 7:
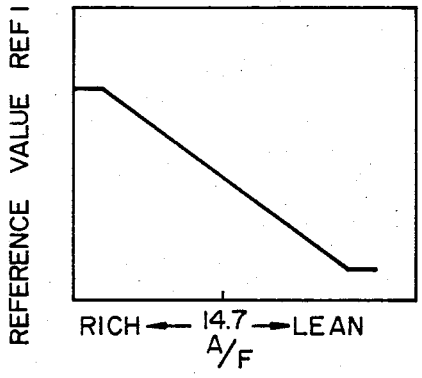
FIG. 7 is a graph showing the relationship between the air-fuel ratio A/F and the reference value REF1.
Figure 5:
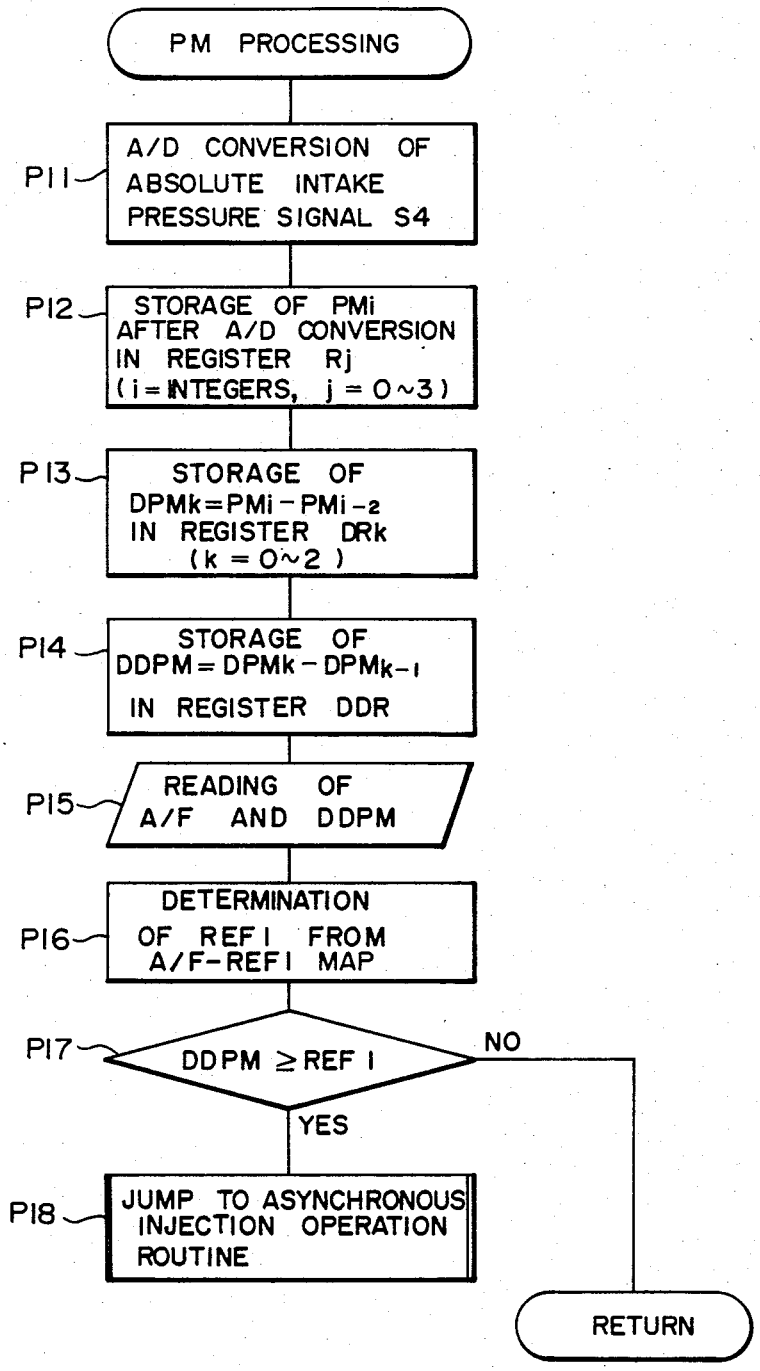
FIG. 5 is a flow chart of an example of a computing process for intake pressure PM.
Figure 6:
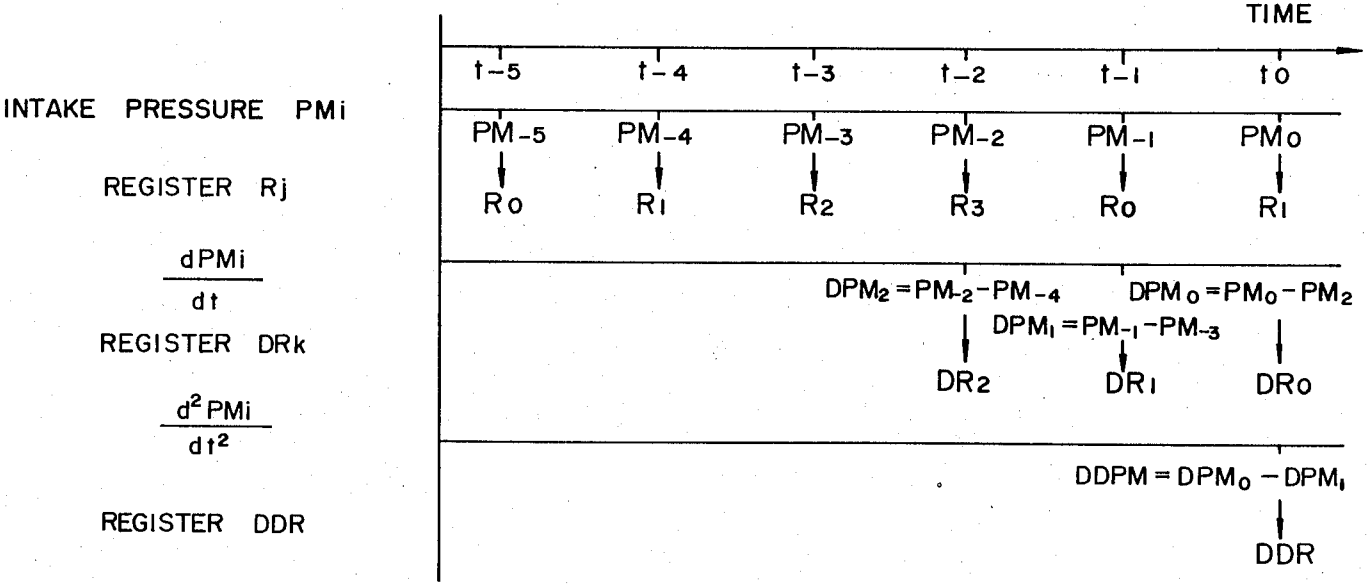
FIG. 6 is an illustration for explaining the steps of the computation as shown in FIG. 5.

As will be seen from FIG. 6, the computation processing of the intake pressure PM shown in FIG. 5 is conducted cyclically at a predetermined period. In a step P11, the signal S4 representing the absolute pressure in the intake passage is changed into digital signals, while in a step P12, the values PMi of the digital signals are successively stored in registers Ro to $R_3$ at a predetermined period. In a step P13, at an instant $t_{-2}$ for example, the intake pressure $PM_{-4}$ stored in the register $R_1$ at an instant $t_{-4}$ is subtracted from the intake pressure $PM_{-2}$ stored in the register $R_3$. The result $CPM_2$ of this subtraction is stored in a register $DR_2$. Then, the process proceeds to a step P14. In this step, at an instant $t_0$ for example, the subtraction result $DPM_1$ stored in the register $DR_1$ is subtracted from the subtraction result DPMo stored in the register DRo. The result DDPM of this subtraction is stored in a register DDR. In a step P15, the changing amount DDPM of the intake pressure PM and the air-fuel ratio A/F computed in a manner explained later are read out and then are stored in predetermined areas. In the next step P16, a reference value REF1 is determined from the read air-fuel ratio A/F using a map which, as shown in FIG. 7, shows the relationship between the air-fuel ratio A/F and the reference value REF1 which is used as the threshold level for the judgement. In a step P17, a judgement is made as to whether the read changing amount DDPM of the pressure is greater than the reference value REF1. If the answer is affirmative, the process proceeds to a step P18 and jumps to an asynchronous fuel injection routine (see FIG. 8). However, if the answer is negative, the intake pressure computing process is once ceased.

Thus, the intake pressure values PM stored in respective registers at every instants are used in the computation of the basic fuel injection time duration. More specifically, the first-order differentiated value DPM of the intake pressure PM, representing the amount of acceleration of the engine, is used for the computation of the synchronous acceleration increment, while the second-order differentiated value DDPM, which also shows the amount of acceleration of the engine, is used for the computation of asynchronous acceleration increment.

The routine for asynchronous fuel injection computing process will be explained hereinunder with reference to FIG. 8.

Figure 9:
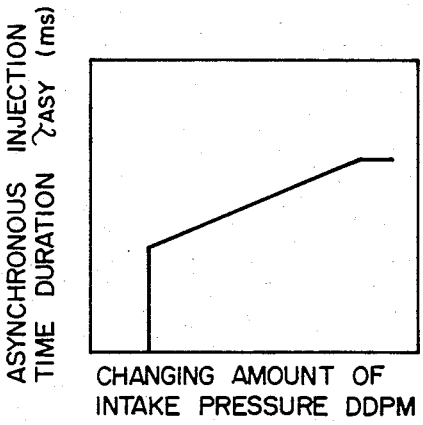
FIG. 9 is a graph showing the relationship between the amount DDPM of change in the intake pressure and the asynchronous fuel injection time $\tau_{ASY}$.

This routine is started through jumping from the step P18 in the process shown in FIG. 5. In this routine, after reading the changing amount DDPM of the pressure from the register DDR in a step P21, the process proceeds to a step P22. In a step P22, the asynchronous fuel injection time duration $\tau_{ASY}$ is determined by the read changing amount DDPM of the intake pressure from a map which, as shown in FIG. 9, shows the relationship between the changing amount DDPM and the asynchronous fuel injection time duration $\tau_{ASY}$. The asynchronous fuel injection time duration $T_{ASY}$ thus determined is stored in a predetermined area. Then, in the next step P23, a correcting processing is conducted to determine the final asynchronous injection time duration $\tau_{ASY}$.

Figure 10:
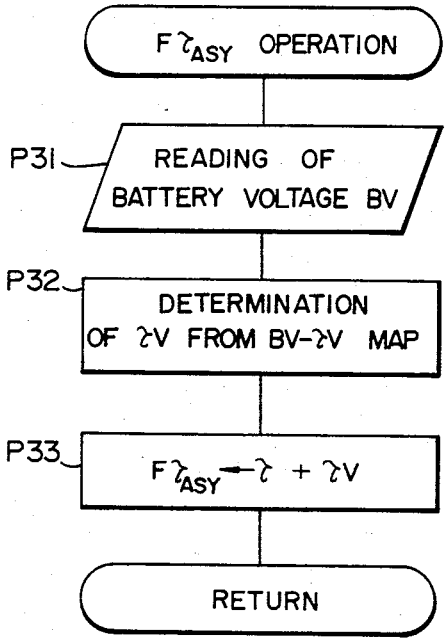
FIG. 10 is a flow chart showing an example of a process for computing the final fuel injection time duration $F\tau_{ASY}$.

FIG. 10 shows an example of the routine for computing the final asynchronous fuel injection time duration $F\tau_{ASY}$.

Figure 11:
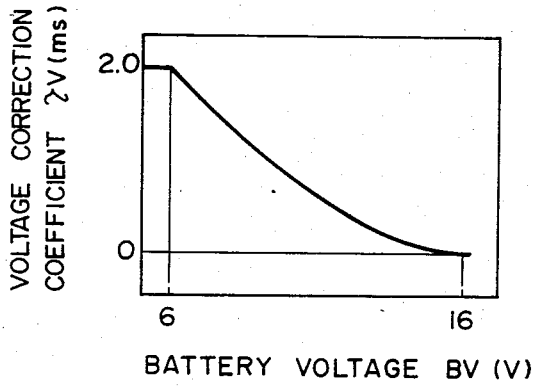
FIG. 11 is a graph showing the relationship between the battery voltage BV and voltage correction coefficient $\tau V$.

In a first step P31, the battery voltage BV is read on the basis of the battery voltage signal S14. Then, in the next step P32, a voltage correction coefficient $\tau V$ is read on the basis of the read battery voltage BV from a map which shows, as will be seen from FIG. 11, the relationship between the battery voltage BV and the voltage correction coefficient $\tau V$. The process then proceeds to a step P33. In a step P33, the value of $(\tau_{ASY}+\tau V)$ is computed to determine the final asynchronous fuel injection time duration $F\tau_{ASY}$ which is then stored in a predetermined memory area. The process then returns to the step P24 in FIG. 8.

Figure 8:
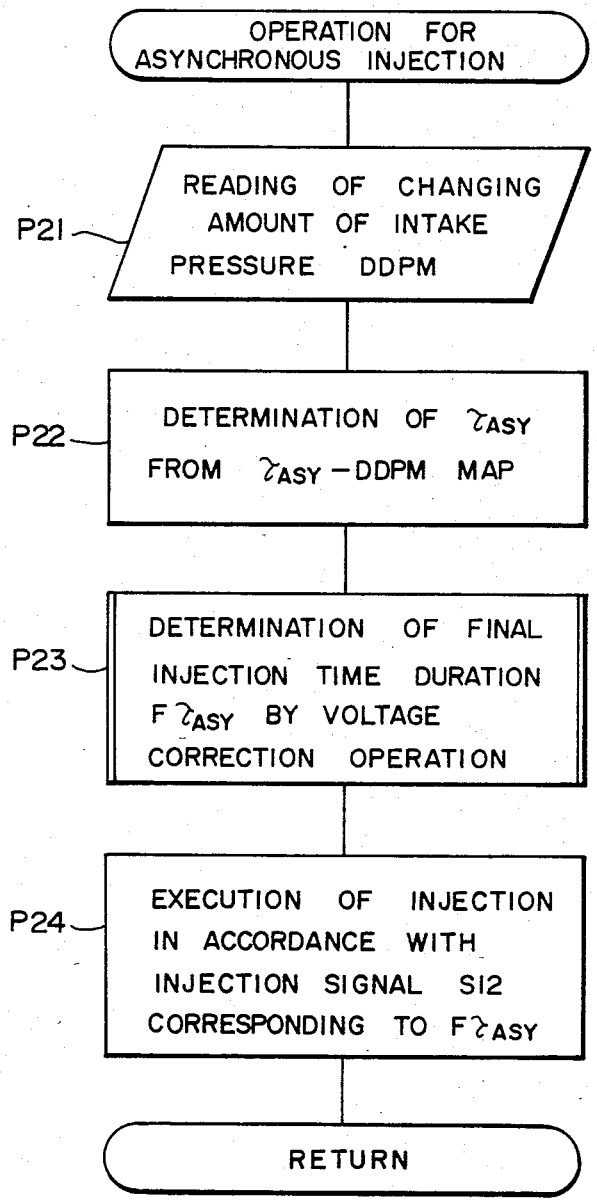
FIG. 8 is a flow chart showing an example of an asynchronous injection computing process.

In the step P24 shown in FIG. 8, an injection signal S12 is produced on the basis of the final asynchronous injection time duration $F\tau_{ASY}$ which has been determined in a step P33 shown in FIG. 10 and is delivered to the injector 7 thereby to effect the asynchronous fuel injection.

As will be understood from the foregoing description, in this embodiment of the invention, the reference level REF1 for judgement as to whether the asynchronous fuel injection is necessary is controlled in view of the air-fuel ratio A/F, such that the reference level REF1 is lowered as the air-fuel ratio A/F becomes greater and is made higher as the air-fuel ratio A/F becomes smaller. In other words, the possibility or chance of the asynchronous fuel injection is decreased as the air-fuel ratio gets smaller, i.e. as the mixture gets richer, for a given amount of acceleration.

A description will be made hereinunder as to the air-fuel ratio A/F.

In the electronic fuel injection controller as shown in FIG. 1, the corrected fuel injection time duration $\tau$ in the synchronous injection mode is determined by the step P3 shown in FIG. 3. In this correcting computation, the basic fuel injection time duration TP is corrected by various correction coefficients such as a warm-up incremental coefficient FWL, a transient-period air-fuel ratio correction coefficient FTC, a feedback correction coefficient FAF, a power incremental coefficient FPO, and a lean correction coefficient FLEAN. The power incremental coefficient FPO takes a value selected in accordance with the engine speed Ne or the intake pressure PM when, for example, the opening degree of the throttle valve 9 exceeds 50°, to make a compensation for the insufficiency of the engine power when the engine is operating under a heavy load. The lean correction coefficient FLEAN takes a value which is selected in accordance with the intake pressure PM under a predetermined condition of engine operation to attain a lean air-fuel mixture thereby to reduce the fuel consumption.

It is, therefore, possible to determine the air-fuel ratio during the operation of the engine, in accordance with the power incremental coefficient EPO and the lean correction coefficient FLEAN.

An explanation will be made hereinunder as to the procedure for determining the power incremental coefficient, with specific reference to FIG. 12.

Figure 12:
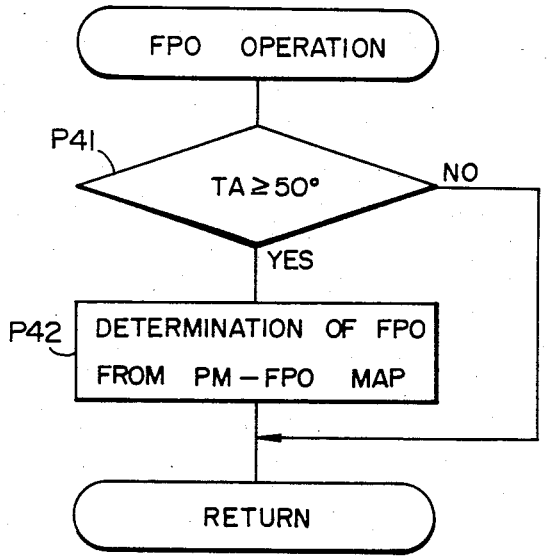
FIG. 12 is a flow chart showing an example of the process for computing the power incremental coefficient FPO.
Figure 13:
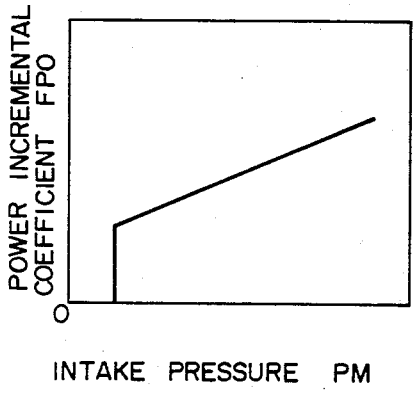
FIG. 13 is a graph showing the relationship between the power incremental coefficient FPO and the intake pressure PM.

As a program shown in FIG. 12 is started, at first a judgement is made in a step P41 as to whether the opening degree TA of the throttle valve 9 is below 50°. If the answer is affirmative, a value of the power incremental coefficient FPO corresponding to the instant intake pressure PM is read in the next step P42 from a map which shows, as will be seen from FIG. 13, the relationship between the intake pressure PM and the power incremental coefficient FPO. The selected value of the power incremental coefficient FPO is stored in a predetermined area. It will be understood that a greater value of the power incremental coefficient FPO means that the combustion is being made at a small air-fuel ratio A/F, i.e. with too rich air-fuel mixture.

The lean correction coefficient FLEAN is determined in a manner which will be described hereinunder with specific referfence to FIG. 14.

Figure 14:
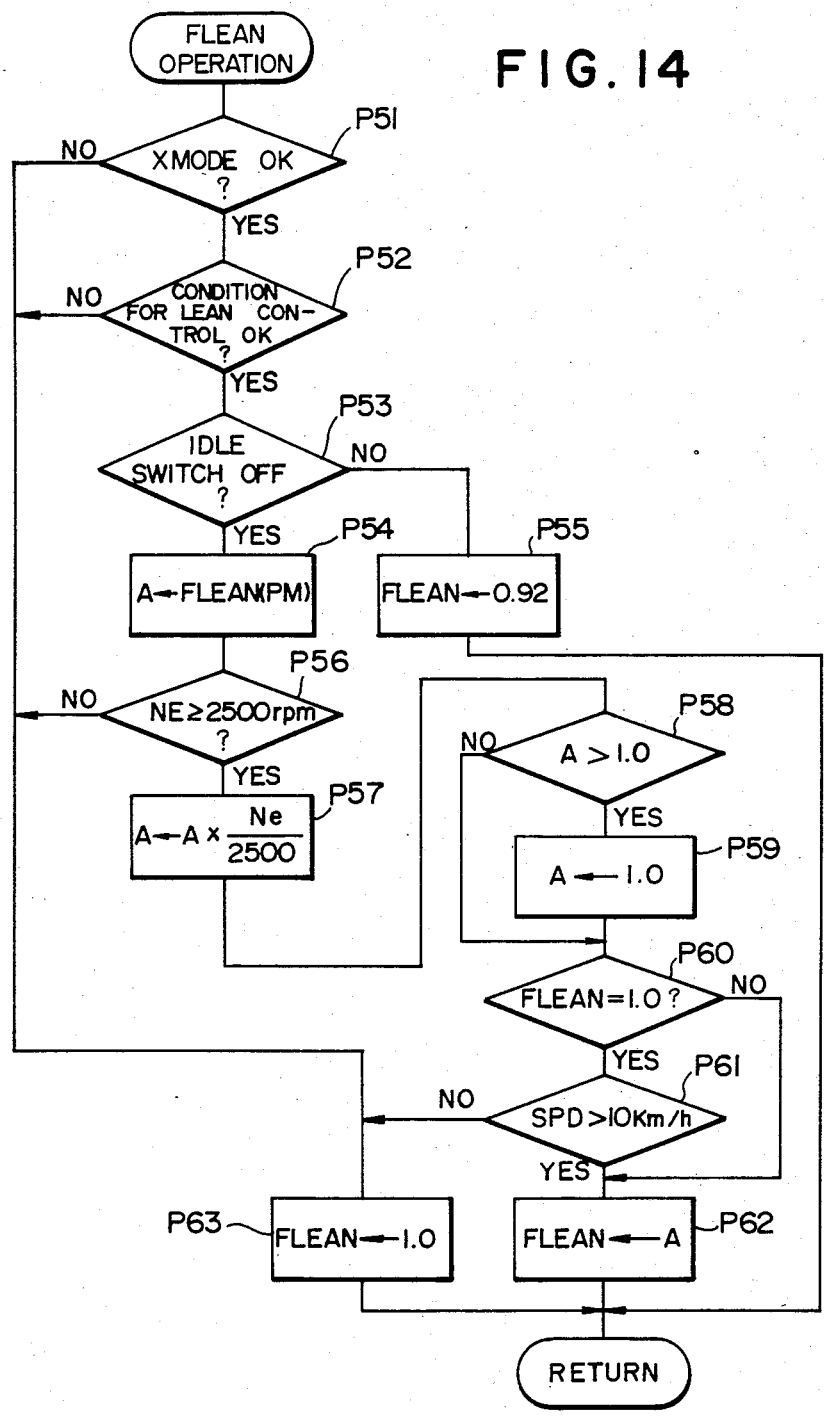
FIG. 14 is a flow chart showing an example of the process for computing the lean correction coefficient FLEAN.

As a program shown in FIG. 14 is started, a judgement is made in a step P51 as to whether the mode condition XMODE is satisfied. More specifically, this condition is satisfied when the engine is not being started up nor in the fuel incremental phase after the starting nor in the power incremental phase. A judgement as to whether the engine is not being started up is made in accordance with the start signal S9 and the engine speed signal S10. The judgement concerning the fuel incremental phase after the starting is made on the basis of post-start fuel incremental coefficient FSE stored in a predetermined memory area. The judgement in regard to the power incremental phase is made through judgement of the power incremental coefficient FPO stored in a predetermined memory area. If this condition is met, a judgement is made in a step P52 as to whether the condition for the lean control is satisfied. If satisfied, the process proceeds to a step P53. In order to satisfy the condition for the lean control, it is necessary that the following condition factors are met: cooling water temperature THW not lower than 80° C., intake pressure PM not lower than 550 mmHg, opening degree of the throttle valve not greater than 50°, and changing amounts of vehicle speed SPD and engine speed Ne not greater than respective predetermined values. These condition factors are judged on the basis of the water temperature signal S6, intake pressure signal S4, power signal S3, vehicle speed signal S8 and the engine speed signal S10.

Figure 15:
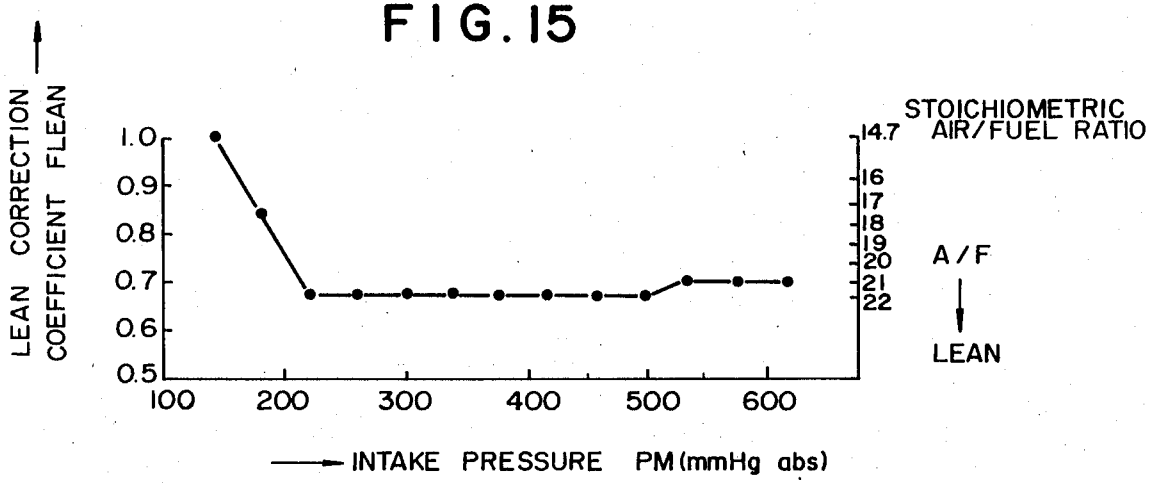
FIG. 15 is a graph showing the relationship between the lean correction coefficient FLEAN and the intake pressure PM.

In a step P53, a judgement is made as to whether the throttle valve 9 is fully closed in accordance with the idle signal S2. If the answer is affirmative, the process proceeds to the step P54. However, if the answer is negative, the process proceeds to the step P55 to set the lean correction coefficient FLEAN stored in the predetermined area of the RAM 61*c* at a value of 0.92 thus completing the FLEAN computing process. In the step P54, the lean correction coefficient FLEAN is determined in accordance with the intake pressure PM from a map which shows, as will be seen from FIG. 15, the relationship between the intake pressure PM and the lean correction coefficient FLEAN, and is temporarily stored in the A register.

Then, the process proceeds to a step P56 in which a judgement is made as to whether the engine speed Ne is higher than 2500 rpm or not. If the answer is affirmative, in a step P57, the content of the A register is multiplied by Ne/2500. In the next step P58, a judgement is made as to whether the result of the multiplication is greater or smaller than 1.0. If greater, the content of the A register is rewritten to be 1.0 in a step P58. If smaller, the process proceeds to a step P60 skipping over the step P59. In a next step P60, a judgement is made as to whether the lean correction coefficient FLEAN is 1.0, i.e. whether the feedback control using the air-fuel ratio signal S7 is conducted. If the answer is affirmative, a judgement is made in the step P61 as to whether the vehicle speed is not lower than 10 Km/h. If the answer is affirmative, the content of the A register is stored in a predetermined area FLEAN of the RAM 61*c*, thereby to complete this process.

When the vehicle speed is not higher than 10 Km/h, when the engine speed Ne is not lower than 2500 rpm, when the condition XMODE is not satisfied and when the condition for the lean control is not satisfied, the value 1.0 is stored in the memory area FLEAN of the RAM 61*c*, thus completing this computation routine.

It will be seen that a small value of the lean correction coefficient FLEAN means that the engine is operating at a large value of the air-fuel ratio A/F, i.e. with a too lean mixture.

Figure 16:
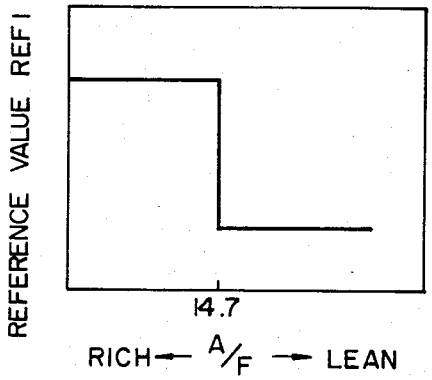
FIG. 16 is a graph showing the level of the reference value REF1 predetermined in accordance with the air-fuel ratio A/F.
Figure 17:
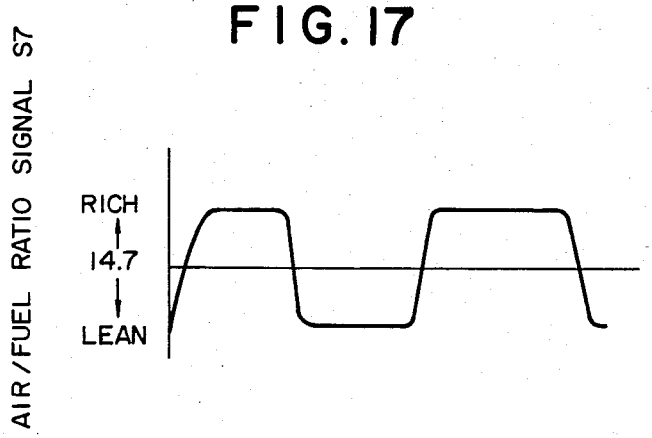
FIG. 17 is a waveform chart for explaining an air-fuel ratio signal S7.

In the embodiment described hereinbefore, as shown in FIG. 16, the two different reference values REF1 as the judging level are prepared and are used selectively depending on whether the actual air-fuel ratio is greater or smaller than the stoichiometric value of 14.7. The judgement as to whether the air-fuel mixture is too rich or too lean can be made in accordance with the air-fuel ratio signal S7 derived from the $O_2$ sensor 41 as shown in FIG. 17. This judgement can be made by means of a comparing means which compares the air-fuel ratio signal S7 with the judging level. This, however, is not exclusive and the judgement can be made by means of a software or by means of two comparators.

Figure 18:
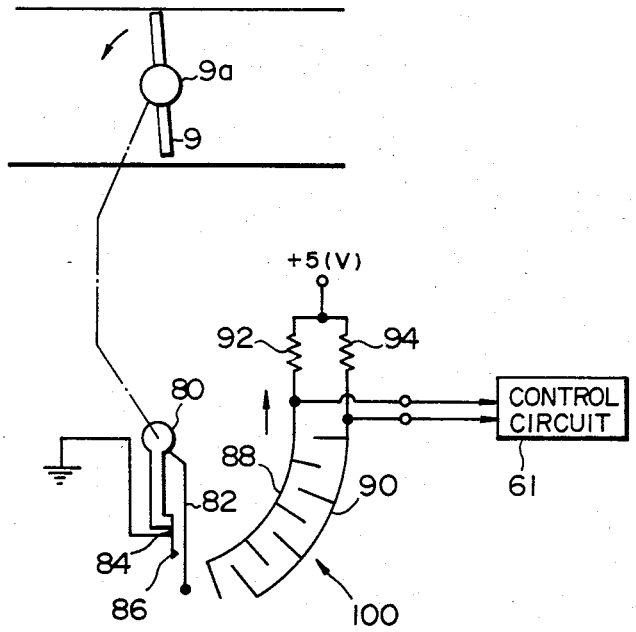
FIG. 18 is a schematic illustration of an example of the acceleration sensor.

An explanation will be made hereinunder as to a second embodiment of the invention in which the amount of acceleration of the engine is detected by means of an acceleration sensor 100 which is associated with the throttle valve 9 as shown in FIG. 18.

Referring to FIG. 18, the acceleration sensor 100 is provided with a substantially L-shaped rotary member 80 which is connected to the rotary shaft 9*a* of the throttle valve 9. A first contact member 82 is fixed at its one end to the base end of the rotary member 80 so as to extend towards the end of the rotary member and so as not to interfere with the end of the rotary member 80. A second contact member 86 is fixed at its one end to the end of the rotary member 80 through an insulation member 84 so as to extend in parallel with the first contactor 82. This second contactor 86 is grounded. A first comb-like electrode 88 and the second comb-like electrode 90 are disposed to oppose to the first contactor 82 in such a manner that the teeth of one of the electrodes are positioned in the spaces between the adjacent teeth of the other electrode. The first and the second electrodes are opened at their one ends while the other ends are connected to a power source through registers 92 and 94 and also to the electronic control circuit 61.

Figure 19:
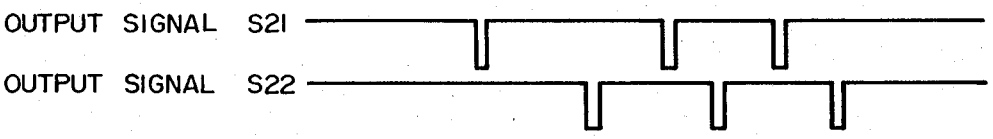
FIG. 19 is a waveform chart showing output signals derived from the respective terminals of the sensor shown in FIG. 18.

In this acceleration sensor 100, as the throttle valve 9 is rotated in the opening direction (direction indicated by arrow), the rotary member 80 is rotated so that, with the first and the second contactors 82 and 86 contacting with each other, the end of the first contactor 82 is grounded while alternatingly contacting the first electrode 88 and the second electrode 90. Consequently, pulse signals S21, S22 of waveforms as shown in FIG. 19 are produced by the acceleration sensor 100. When the throttle valve 9 is rotated in the closing direction, no pulse signal is produced because the first and the second contactors 82 and 86 do not contact with each other.

Figure 20:
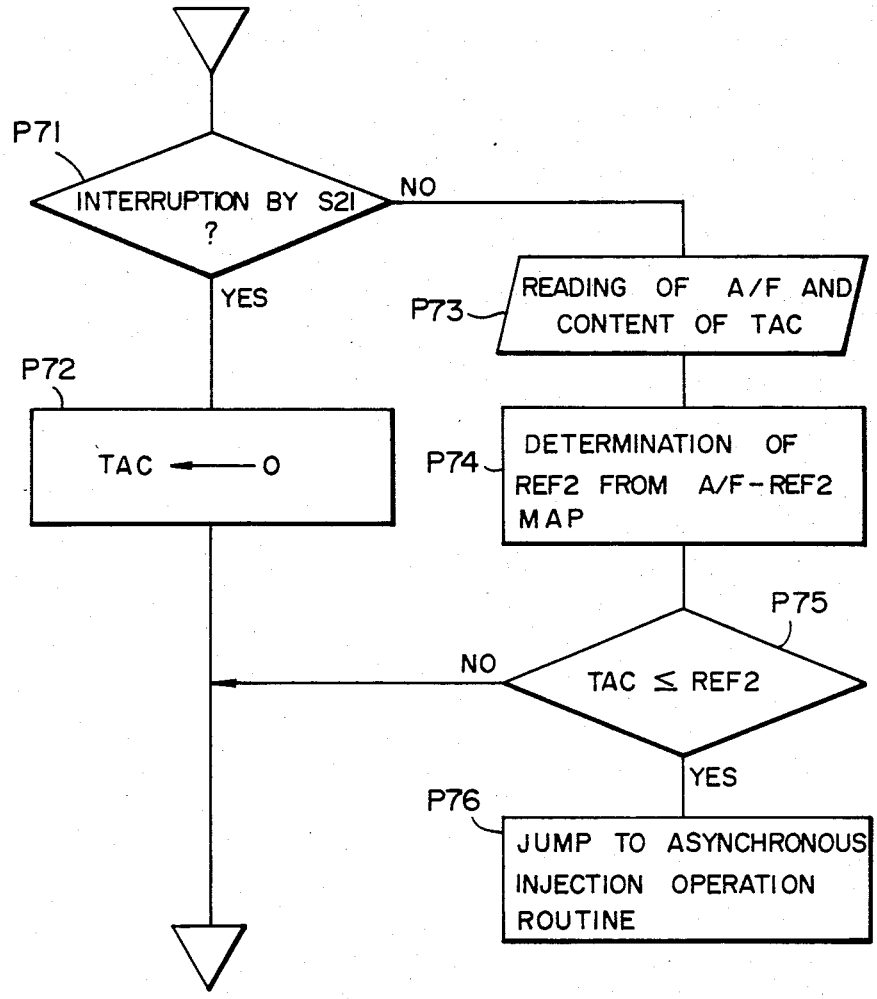
FIG. 20 is a flow chart showing an example of a process for computing the amount of change in rotation of the throttle valve from the output signals of the sensor shown in FIG. 18.

A computation is made to determine the amount of the engine acceleration by processing the output signals S21 and S22 in a manner explained in FIG. 20 and a judgement as to whether the asynchronous injection is necessary is conducted in accordance with the thus computed amount of engine acceleration.

In the program shown in FIG. 20, an interruption is made in response to the trailing edges of the pulse signals S21 and S22 from the first and second electrodes of the acceleration sensor 100.

Figure 21:
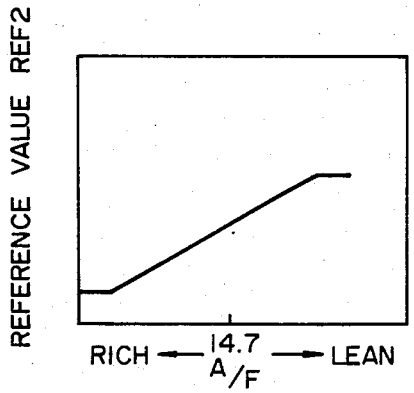
FIG. 21 is a graph showing the relationship between the air-fuel ratio A/F and the reference value REF2.

In a step P71, a judgement is made as to whether the present interruption is the one caused in response to the trailing edge of the pulse signal S21 outputted from the first electrode. If the answer is affirmative, i.e. if the present interruption has been made by the trailing edge of the pulse signal S21 outputted from the first electrode, the process returns to the main routine, after clearing the acceleration judging timer $T_{AC}$ in a step P72. However, if the answer is negative, i.e. if the present interruption is the one caused by the signal S22 outputted from the second electrode, the air-fuel ratio A/F is read together with the content of the timer $T_{AC}$ at that instant. Subsequently, the process proceeds to a step P74 in which the reference value REF2 is read using the read air-fuel ratio A/F from a map which shows, as will be seen from FIG. 21, the relationship between the air-fuel ratio A/F and the reference value REF2. In a step P75, a comparison is made between the content of the timer $T_{AC}$ and the reference value REF2, and the process is returned to the main routine if the content of the timer $T_{AC}$ is greater than the reference value REF2. However, if the content of the timer $T_{AC}$ is smaller than the reference value REF2, the process proceeds to a step P76 and jumps to the asynchronous routine (see FIG. 22).

Figure 23:
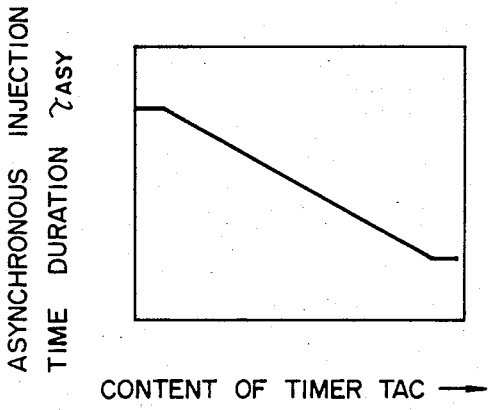
FIG. 23 is a graph showing the relationship between the asynchronous fuel injection time $\tau_{ASY}$ and the content of a timer $T_{AC}$.
Figure 22:
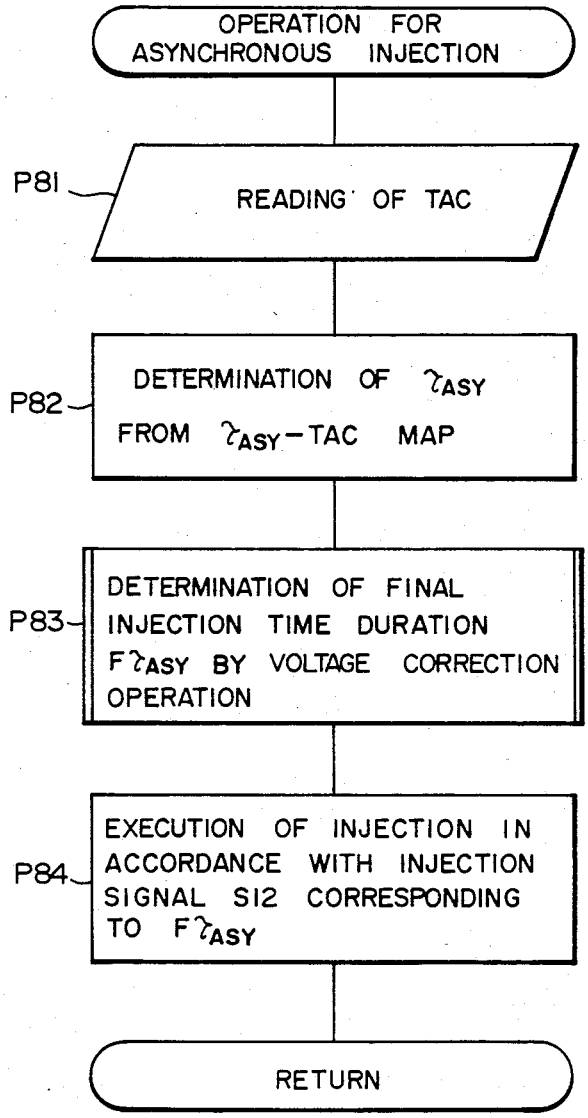
FIG. 22 is a flow chart showing another example of the asynchronous fuel injection computing process.

Referring to FIG. 22, as the asynchronous injection routine is started, the content of the timer $T_{AC}$ read in the step P73 shown in FIG. 20, i.e. the time elapsed from the instant of the fall of the first pulse signal S21 to the instant of the fall of the second pulse signal S22, is read again in a step P81. In the next step P82, the asynchronous fuel injection time duration $\tau_{ASY}$ is read using the content $T_{AC}$ of the timer from a map which shows, as will be seen in FIG. 23, the relationship between the asynchronous injection time duration $\tau_{ASY}$ and the timer content $T_{AC}$. Then, in a step P83, a voltage compensation is effected in the same procedure as that explained before and, in a step P84, an injection signal S12 corresponding to the final injection time duration $F\tau_{ASY}$ is generated and supplied to the injector 7. Consequently, the injector 7 is kept opened for a time length corresponding to the final injection time duration $F\tau_{ASY}$.

Thus, in the second embodiment of the invention, the time interval between two different signals S21 and S22, which are produced alternatingly in accordance with the rotation of the throttle valve 9, is measured by the timer $T_{AC}$ and is compared with the reference time REF2. If the measured time interval is shorter than the reference value REF2, the asynchronous injection is conducted while varying the reference value REF2 in accordance with the air-fuel ratio A/F.

A third embodiment of the invention will be described hereinunder with reference to FIGS. 24 to 27.

Figure 24:
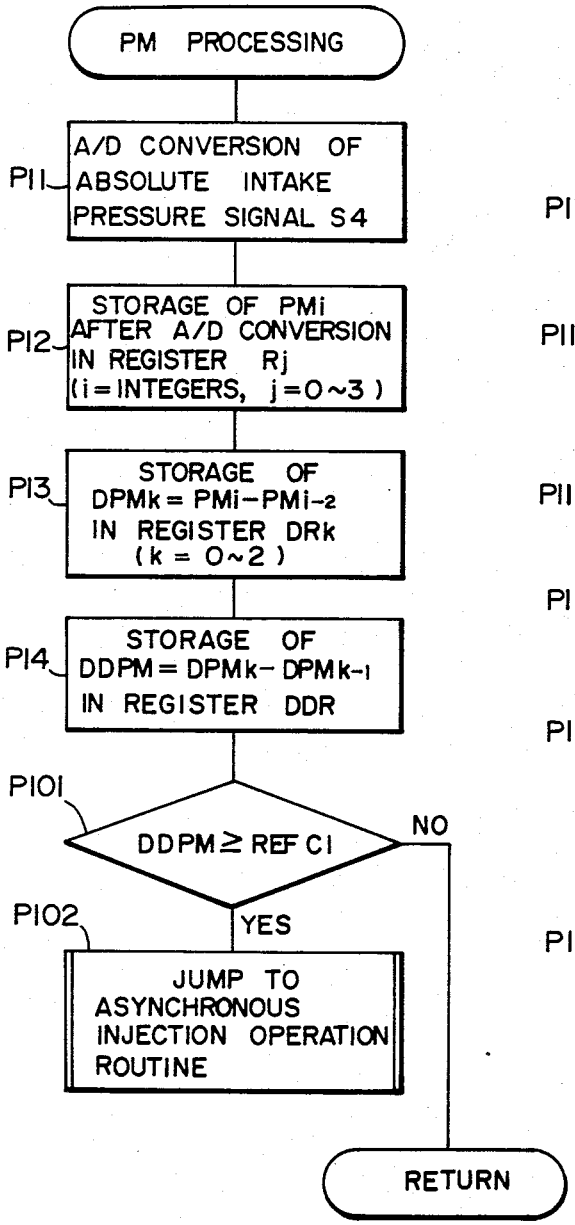
FIG. 24 is a flow chart showing another example of the process for computing the intake pressure PM.

As in the case of the first embodiment described before, in this third embodiment, the asynchronous fuel injection is conducted when the amount $d^2PM/dt^2$ of change of the intake pressure PM exceeds a predetermined value. Namely, a computing processing of the intake pressure PM is conducted in accordance with the process as shown in FIG. 24. Steps P11 to P14 of this process are identical with the steps P11 to P14 of the process shown in FIG. 24 and, hence, are not described here to avoid duplication of the description.

In a step P101, the second-order differentiated value DDPM representing the amount of change in the intake pressure PM, stored in the register DDR, is compared with a predetermined reference value REFC1. If the condition of DDPM≧REFC1 is met, the process jumps to an asynchronous fuel injection routine (see FIG. 25). On the other hand, if the condition DDPM≦REFC1 is met, this process is finished.

The routine of the asynchronous fuel injection computing process will be explained hereinunder with specific reference to FIG. 25.

This routine is started by a jumping from the step P102 shown in FIG. 24. After reading the pressure changing amount DDPM stored in the register DDR and the air-fuel ratio A/F in a step P111, the process proceeds to a step P112. In the step P112, a value of asynchronous injection time duration $TP_{ASY}$ is read using the read pressure changing amount DDPM from a map which shows, as will be seen from FIG. 26, the relationship between the intake pressure changing amount DDPM and the asynchronous fuel injection time duration $TP_{ASY}$, and the read value of the asynchronous fuel injection time duration $TP_{ASY}$ is stored in a predetermined area. Then, in a step P113, a correction coefficient k is determined using the read value of the air-fuel ratio A/F from a map which shows, as will be seen from FIG. 27, the relationship between the correction coefficient k and the air-fuel ratio A/F. In a step P114, the corrected fuel injection time duration $\tau_{ASY}$ is determined by multiplying the asynchronous fuel injection time duration $TP_{ASY}$ by the correction coefficient k, and is stored in a predetermined area. The process then proceeds to a step P115 in which a correcting processing is conducted in accordance with the battery voltage to determine the final asynchronous fuel injection time duration $F\tau_{ASY}$. The determination of the final asynchronous injection time duration $F\tau_{ASY}$ is made in the same manner as the that explained before in connection with FIG. 10. After storing the final asynchronous injection time duration $F\tau_{ASY}$ thus determined in a predetermined area, the process returns to the step P116 shown in FIG. 25.

Figure 25:
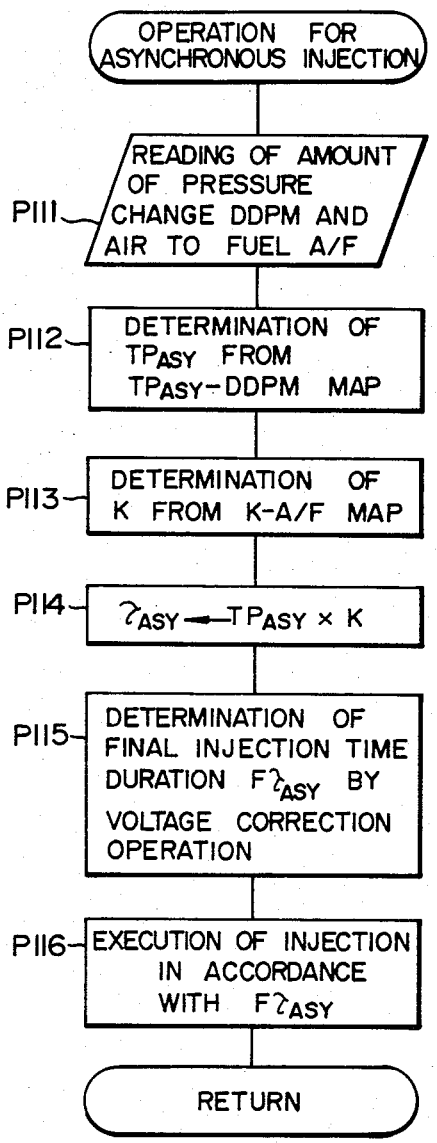
FIG. 25 is a flow chart showing still another example of the asynchronous fuel injection computing process.
Figure 26:
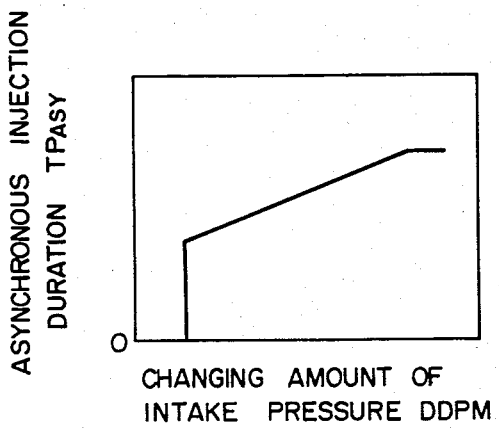
FIG. 26 is a graph showing the relationship between the amount DDPM of change in the intake pressure and the asynchronous fuel injection time $\tau P_{ASY}$.
Figure 27:
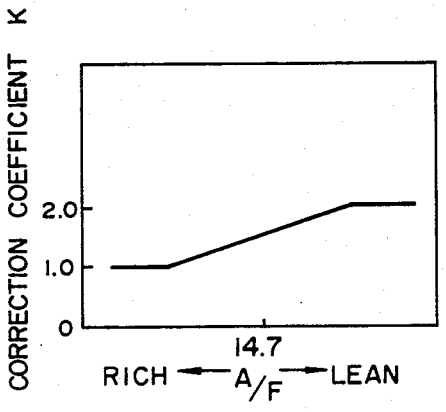
FIG. 27 is a graph showing the relationship between the correction coefficient K and the air-fuel ratio A/F.

In a step P116 shown in FIG. 25, a fuel injection signal S12 is generated in accordance with the final asynchronous injection time duration $F\tau_{ASY}$ and is delivered to the injector 7 thereby to effect the asynchronous fuel injection.

As has been described, in this embodiment of the invention, the asynchronous fuel injection time duration $TP_{ASY}$ determined in accordance with the intake pressure changing amount DDPM is multiplied by the correction coefficient k ($k \geqq 1.0$) which takes a greater value as the air-fuel ratio A/F is increased. In consequence, the amount of fuel injected by the asynchronous fuel injection is smaller as the air-fuel ratio A/F gets smaller, i.e. as the air-fuel mixture becomes richer.

Figure 28:
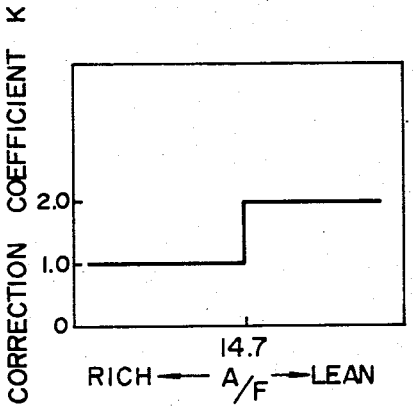
FIG. 28 is a graph showing the value of the correction coefficient K predetermined in accordance with the air-fuel ratio A/F.

By preparing two different values of correction coefficient k at both sides of the stoichiometric air-fuel ratio of 14.7 as shown in FIG. 28, it is possible to arrange such that the judgement as to whether the mixture is too rich or too lean is conducted on the basis of the air-fuel ratio signal S7 from the $O_2$ sensor 41, in the same manner as that explained before in connection with FIG. 17.

A fourth embodiment will be explained hereinunder. In this fourth embodiment, the amount of engine acceleration is detected by the acceleration sensor 100 as shown in FIG. 18 and the amount of the asynchronous fuel injection is controlled in accordance with the air-fuel ratio.

Figure 29:
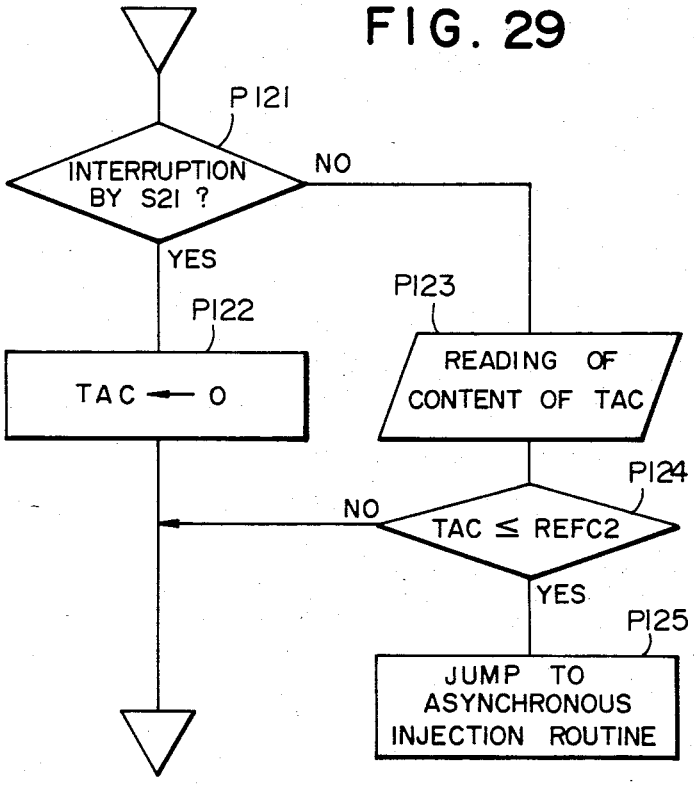
FIG. 29 is a flow chart of another example of the process for computing the amount of change in rotation of the throttle valve from the sensors shown in FIG. 18.

An interruption to the program shown in FIG. 29 is made in response to the trailing edges of the pulse signals S21 and S22 delivered by the first and second electrodes of the acceleration sensor 100.

In a step P121, a judgement is made as to whether the present interruption is caused in response to the trailing edge of the pulse signal S21 outputted from the first electrode. If the interruption is caused by the signal S21 from the first electrode, the process returns to the main routine after clearing the acceleration judging timer $T_{AC}$. On the other hand, if the interruption is caused by the signal S22 from the second electrode, the process proceeds to a step P124 after reading the content of the timer $T_{AC}$ in a step P123. In the step P124, the content of the timer $T_{AC}$ is compared with the reference value REFC2. If the result of the comparison is negative, i.e. if the content of the timer $T_{AC}$ is greater than the reference value REFC2, the process returns to the main routine. On the other hand, if the result of the comparison is positive, i.e. if content of the timer $T_{AC}$ is smaller than the reference value $REFC_2$, the process proceeds to a step P125 and jumps to the asynchronous injection routine (see FIG. 30).

Figure 31:
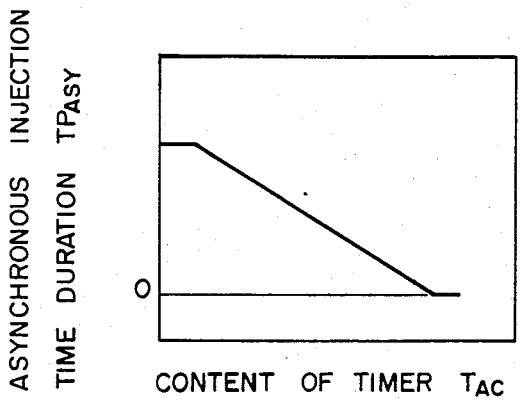
FIG. 31 is a graph showing the asynchronous fuel injection time $TP_{ASY}$ and the content of the timer $T_{AC}$.
Figure 30:
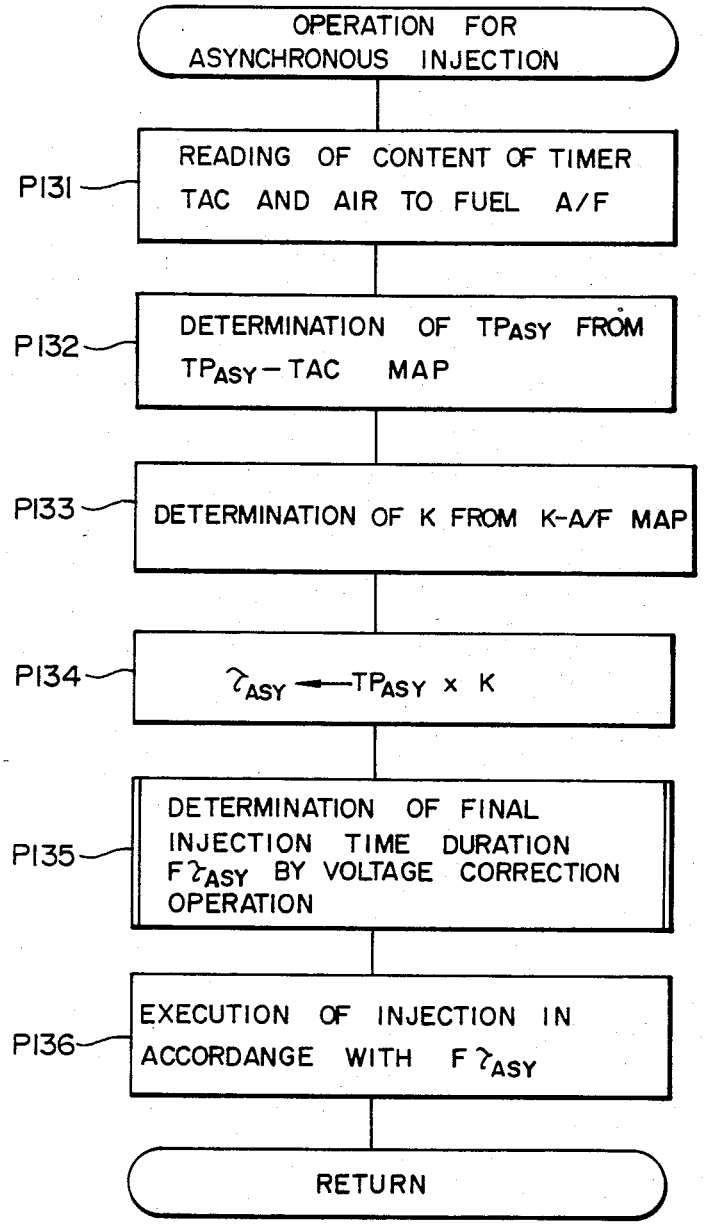
FIG. 30 is a flow chart showing another example of the asynchronous fuel injection computing process.

Referring to FIG. 30, as the asynchronous routine is started in a manner described, the content of the timer $T_{AC}$ read in the step 123 of the process shown in FIG. 29, i.e. the time length between the trailing edge of the first pulse signal S21 and the trailing edge of the second pulse signal S22 is read again in a step P131. The process then proceeds to a step P132 in which the asynchronous fuel injection time duration $TP_{ASY}$ is read in accordance with the content of the timer $T_{AC}$ from a map which shows, as will be seen from FIG. 31, the relationship between the asynchronous fuel injection time duration $TP_{ASY}$ and the content of the timer $T_{AC}$. Subsequent steps P133 to 136 are then taken. These steps are indetical with the steps P113 to P116 of the process shown in FIG. 15 and, hence, are not described here.

As will be seen from the foregoing description, in the fourth embodiment of the invention, the time interval between two different signals S21 and S22, outputted in acordance with the rotation of the throttle valve 9 is measured by the timer $T_{AC}$ and is compared with the reference value REFC2. The asynchronous fuel injection is conducted if the content of the timer $T_{AC}$ is smaller than the reference value REF2, and the amount of fuel injected in this asynchronous fuel injection is controlled such that the amount of fuel injected is made smaller as the air-fuel ratio gets smaller.

What is claimed is:

1. A method of controlling a fuel injection in an internal combustion engine for effecting an asynchronous fuel injection from a fuel injector when an amount of an engine acceleration exceeds a predetermined judging level, comprising the steps of:

detecting an air-fuel ratio of a mixture as an index of the state of combustion in said engine; and controlling said judging level in accordance with said air-fuel ratio thus detected such that said judging level is raised as said air-fuel ratio gets smaller.

2. A device for controlling a fuel injection in an internal combustion engine comprising:

an acceleration detecting means for detecting an amount of acceleration of said engine;

an air-fuel ratio detecting means for detecting an air-fuel ratio as an index representing the state of combustion in said engine;

a judging means adapted to make a judgement as to whether an asynchronous fuel injection by an injector is necessary in accordance with a judging level and to allow the asynchronous fuel injection when the amount of engine acceleration exceeds said judging level;

a judging level changing means adapted to control said judging level in accordance with air-fuel ratio detected by said air-fuel ratio detecting means such that said level is raised as said air-fuel ratio becomes smaller; and a signal generating means adapted to generating an injection signal for driving said injector for a predetermined time length when said asynchronous fuel injection is allowed by said judging means.

3. A device for controlling a fuel injection according to claim 2, wherein said acceleration detecting means includes:

a pressure detecting means for detecting an intake pressure; and a changing amount computing means for computing the amount of change of said intake pressure detected by said pressure detecting means, thereby to detect said amount of acceleration of said engine in accordance with said amount of change of said intake pressure.

4. A device for controlling a fuel injection according to claim 3, wherein said air-fuel ratio detecting means includes:

an $O_2$ sensor adapted to produce an air-fuel ratio signal corresponding to a content of oxygen remaining in an exhaust gas; and a judging means adapted to judge an air-fuel mixture to be too rich and too lean, respectively, when the level of said air-fuel ratio signal is higher and lower than a predetermined level.

5. A device for controlling a fuel injection according to claim 3, further comprising:

a basic fuel injection time duration computing means adapted to compute the basic fuel injection time duration corresponding to a basic opening time duration of said injector, in accordance with an engine speed detected by an engine speed detecting means and the load detected by an engine load detecting means; and a correcting means for correcting said basic fuel injection time duration at least by a power incremental coefficient and a lean correction coefficient, said power incremental coefficient being determined for increasing said basic fuel injection time duration in accordance with the engine speed or the engine load when an opening degree of a throttle valve is greater than a predetermined opening degree, said lean correction coefficient being determined, under a predetermined condition of the engine operation, in accordance with the engine load so as to decrease said basic fuel injection time duration thereby to operate said engine with a lean mixture;

said air-fuel ratio detecting means being adapted to detect the air-fuel ratio in accordance with said power incremental coefficient and said lean correction coefficient.

6. A device for controlling a fuel injection according to claim 4, wherein said changing means is adapted to selectively set one of two judging levels depending on whether said judging means is judging the mixture to be too rich or too lean.

7. A device for controlling a fuel injection according to claim 2, wherein said air-fuel ratio detecting means includes:

an $O_2$ sensor adapted to produce an air-fuel ratio signal corresponding to a content of oxygen remaining in an exhaust gas; and a judging means adapted to judge an air-fuel mixture to be too rich and too lean, respectively, when the level of said air-fuel ratio signal is higher and lower than a predetermined level.

8. A device for controlling a fuel injection according to claim 7, wherein said changing means is adapted to selectively set one of two judging levels depending on whether said judging means is judging the mixture to be too rich or too lean.

9. A device for controlling a fuel injection according to claim 2, further comprising:

a basic fuel injection time duration computing means adapted to compute a basic fuel injection time duration corresponding to a basic opening time duration of said injector, in accordance with an engine speed detected by an engine speed detecting means and a load detected by an engine load detecting means; and a correcting means for correcting said basic fuel injection time duration at least by a power incremental coefficient and a lean correction coefficient, said power incremental coefficient being determined for increasing said basic fuel injection time duration in accordance with the engine speed or the engine load when an opening degree of a throttle valve is greater than a predetermined opening degree, said lean correction coefficient being determined, under a predetermined condition of the engine operation, in accordance with the engine load so as to decrease said basic fuel injection time duration thereby to operate said engine with a lean mixture;

said air-fuel ratio detecting means being adapted to detect the air-fuel ratio in accordance with said power incremental coefficient and said lean correction coefficient.

10. A device for controlling a fuel injection according to claim 2, wherein said acceleration detecting means includes:

an acceleration sensor having a contactor operatively connected to a throttle valve, and a comb-like first electrode and a comb-like second electrode which are arranged such that teeth of one electrode are located in a gap between the adjacent teeth of the other electrode, said contactor contacts said first and second electrodes alternatingly in accordance with the rotation of said throttle valve so that said acceleration sensor produces a first output signal and a second output signal alternatingly as said contactor contacts said first and second electrodes alternatingly; and a measuring means for measuring the time interval between said first output signal and said second output signal, thereby to detect said amount of acceleration of said engine in accordance with said time interval.

11. A device for controlling a fuel injection according to claim 10, further comprising:

a basic fuel injection time duration computing means adapted to compute the basic fuel injection time duration corresponding to a basic opening time duration of said injector, in accordance with an engine speed detected by an engine speed detecting means and the load detected by an engine load detecting means; and a correcting means for correcting said basic fuel injection time duration at least by a power incremental coefficient and a lean correction coefficient, said power incremental coefficient being determined for increasing said basic fuel injection time duration in accordance with the engine speed or the engine load when an opening degree of said throttle valve is greater than a predetermined opening degree, said lean correction coefficient being determined, under a predetermined condition of the engine operation, in accordance with the engine load so as to decrease said basic fuel injection time duration thereby to operate said engine with a lean mixture;

said air-fuel ratio detecting means being adapted to detect the air-fuel ratio in accordance with said power incremental coefficient and said lean correction coefficient.

12. A device for controlling a fuel injection according to claim 10, wherein said air-fuel ratio detecting means includes:

an $O_2$ sensor adapted to produce an air-fuel ratio signal corresponding to a content of oxygen remaining in an exhaust gas; and a judging means adapted to judge a air-fuel mixture to be too rich and too lean, respectively, when the level of said air-fuel ratio signal is higher and lower than a predetermined level.

13. A device for controlling a fuel injection according to claim 12, wherein said changing means is adapted to selectively set one of two judging levels depending on whether said judging means is judging the mixture to be too rich or too lean.

14. A method of controlling a fuel injection in an internal combustion engine for effecting an asynchronous fuel injection from a fuel injector when an amount of an engine acceleration exceeds a predetermined judging level, comprising the steps of:

detecting an air-fuel ratio of a mixture as an index of the state of combustion in said engine; and controlling an amount of fuel injected by said asynchronous injection in accordance with said air-fuel ratio such that said amount of fuel injected is decreased as said air-fuel ratio gets smaller.

15. A device for controlling a fuel injection in an internal combustion engine comprising:

an acceleration detecting means for detecting an amount of acceleration of said engine;

an air-fuel ratio detecting means for detecting an air-fuel ratio as an index representing the state of combustion in said engine;

a judging means adapted to make a judgement as to whether an asynchronous fuel injection by an injector is necessary in accordance with a judging level and to allow the asynchronous fuel injection when the amount of engine acceleration exceeds said judging level;

a correcting means adapted to correct the amount of the fuel injected by said asyncronous fuel injection such that said amount of fuel injected is decreased as said air-fuel ratio detected by said air-fuel ratio detecting means gets smaller; and a signal generating means adapted to generating an injection signal for driving said injector for an asynchronous fuel injection time duration corresponding to the corrected amount of fuel injected when said asynchronous fuel injection is allowed by said judging means.

16. A device for controlling a fuel injection according to claim 15, wherein said acceleration detecting means includes:

a pressure detecting means for detecting an intake pressure; and a changing amount computing means for computing the amount of change of said intake pressure detected by said pressure detecting means, thereby to detect said amount of acceleration of said engine in accordance with said amount of change of said intake pressure.

17. A device for controlling a fuel injection according to claim 16, wherein said air-fuel ratio detecting means includes;

an $O_2$ sensor adapted to produce an air-fuel ratio signal corresponding to a content of oxygen remaining in an exhaust gas; and a judging means adapted to judge an air-fuel mixture to be too rich and too lean, respectively, when the level of said air-fuel ratio signal is higher and lower than a predetermined level.

18. A device for controlling a fuel injection according to claim 16, further comprising:

a basic fuel injection time duration computing means adapted to compute a basic fuel injection time duration corresponding to a basic opening time duration of said injector, in accordance with an engine speed detected by an engine speed detecting means and a load detected by an engine load detecting means; and a correcting means for correcting said basic fuel injection time duration at least by a power incremental coefficient and lean correction coefficient, said power incremental coefficient being determined for increasing said basic fuel injection time duration in accordance with the engine speed or the engine load when the opening degree of a throttle valve is greater than a predetermined opening degree, said lean correction coefficient being determined, under a predetermined condition of the engine operation, in accordance with the engine load so as to decrease said basic fuel injection time thereby to operate said engine with a lean mixture;

said air-fuel ratio detecting means being adapted to detect the air-fuel ratio in accordance with said power incremental coefficient and said lean correction coefficient.

19. A device for controlling a fuel injection according to claim 15, wherein said acceleration detecting means includes:

an acceleration sensor having a contactor operatively connected to a throttle valve, and a comb-like first electrode and a comb-like second electrode which are arranged such that teeth of one electrode are located in a gap between the adjacent teeth of the other electrode, said contactor contacts said first and second electrodes alternatingly in accordance with a rotation of said throttle valve so that said acceleration sensor produces a first output signal and a second output signal alternatingly as said contactor contacts said first and second electrodes alternatingly; and a measuring means for measuring the time interval between said first output signal and said secnd output signal, thereby to detect said amount of acceleration of said engine in accordance with said time interval.

20. A device for controlling a fuel injection according to claim 19, wherein said air-fuel ratio detecting means includes:

an $O_2$ sensor adapted to produce an air-fuel ratio signal corresponding to a content of oxygen remaining in an exhaust gas; and a judging means adapted to judge an air-fuel mixture to be too rich and too lean, respectively, when the level of said air-fuel ratio signal is higher and lower than a predetermined level.

21. A device for controlling a fuel injection according to claim 19, further comprising:

a basic fuel injection time duration computing means adapted to compute a basic fuel injection time duration corresponding to a basic opening time duration of said injector, in accordance with an enginge speed detected by an enginge speed detecting means and a load detected by an engine load detecting means; and a correcting means for correcting said basic fuel injection time duration at least by a power incremental coefficient and a lean correction coefficient, said power incremental coefficient being determined for increasing said basic fuel injection time duration in accordance with the engine speed or the engine load when the opening degree of said throttle valve is greater than a predetermined opening degree, said lean correction coefficient being determined, under a predetermined condition of the engine operation, in accordance with the engine load so as to decrease said basic fuel injection time duration thereby to operate said engine with a lean mixture;

said air-fuel ratio detecting means being adapted to detect the air-fuel ratio in accordance with said power incremental coefficient and said lean correction coefficient.

22. A device for controlling a fuel injection according to claim 15, wherein said air-fuel ratio detecting means includes:

an $O_2$ sensor adapted to produce an air-fuel ratio signal corresponding to a content of oxygen remaining in an exhaust gas; and a judging means adapted to judge an air-fuel mixture to be too rich and too lean, respectively, when the level of said air-fuel ratio signal is higher and lower than a predetermined level.

23. A device for controlling a fuel injection according to claim 15, further comprising:

a basic fuel injection time duration computing means adapted to compute a basic fuel injection time duration corresponding to a basic opening time duration of said injector, in accordance with an engine speed detected by an engine speed detecting means and a load detected by an engine load detecting means; and a correcting means for correcting said basic fuel injection time duration at least by a power incremental coefficient and a lean correction coefficient, said power incremental coefficient being determined for increasing said basic fuel injection time duration in accordance with the engine speed or the engine load when the opening degree of a throttle valve is greater than a predetermined opening degree, said lean correction coefficient being determined, under a predetermined condition of the engine operation, in accordance with the engine load so as to decrease said basic fuel injection time duration thereby to operate said engine with a lean mixture;

said air-fuel ratio detecting means being adapted to detect the air-fuel ratio in accordance with said power incremental coefficient and said lean correction coefficient.

* * * * *